United States Patent [19]

Flatt

[11] Patent Number: 4,934,890

[45] Date of Patent: Jun. 19, 1990

[54] BINDING OF PERFORATED SHEETS

[75] Inventor: Wayne L. Flatt, Farnborough, Great Britain

[73] Assignee: James Burn International Limited, Surrey, England

[21] Appl. No.: 286,899

[22] Filed: Dec. 20, 1988

[30] Foreign Application Priority Data

Dec. 22, 1987 [GB] United Kingdom ..... 8729897

[51] Int. Cl.[5] ..... B42B 5/10

[52] U.S. Cl. ..... 412/39; 412/4; 412/9

[58] Field of Search ..... 412/39, 3, 4, 7, 9, 412/38, 40; 281/27.1, 27.2

[56] References Cited

U.S. PATENT DOCUMENTS 3,451,081 6/1969 Liouville ..... 412/39

FOREIGN PATENT DOCUMENTS 0322163 6/1989 European Pat. Off. ..... 412/39
1542471 10/1968 France ..... 412/39
1209939 10/1970 United Kingdom .
1209940 10/1970 United Kingdom .
1541225 2/1975 United Kingdom .

*Primary Examiner*—Paul A. Bell

*Assistant Examiner*—Thomas Hamill, Jr.

*Attorney, Agent, or Firm*—Wood, Herron & Evans

[57] ABSTRACT

Apparatus for closing wire binding elements of the type formed from a length of wire which is bent to form a series of curved hairpin shaped prongs, the curvature of the prongs being such that the element has the appearance of an open sided cylinder with a substantially C-shaped cross section, the apparatus comprises two opposed 'closing' jaws, each having a working surface which is a segment of a cylinder, the diameter of which corresponds to the diameter of a desired binding element, when closed, the jaws being arranged to rotate in opposite directions about a fixed horizontal axis or pivot center, the arrangement being such that as the jaws pivot a force is applied by their working surfaces to a binding element located therebetween to cause the element to close to a position in which the closed ends or points are brought into the vicinity of the open ends or roots, the closing jaws being set so that that edge of the working surface which, in use, is located adjacent a bundle of sheets to be bound exactly coincides with the pivot center of each jaw characterized in that means are provided to adjust the position of the pivot centers of each of the jaws towards and away from each other so that closing jaws of different size may be accommodated.

9 Claims, 6 Drawing Sheets

Figure 5:
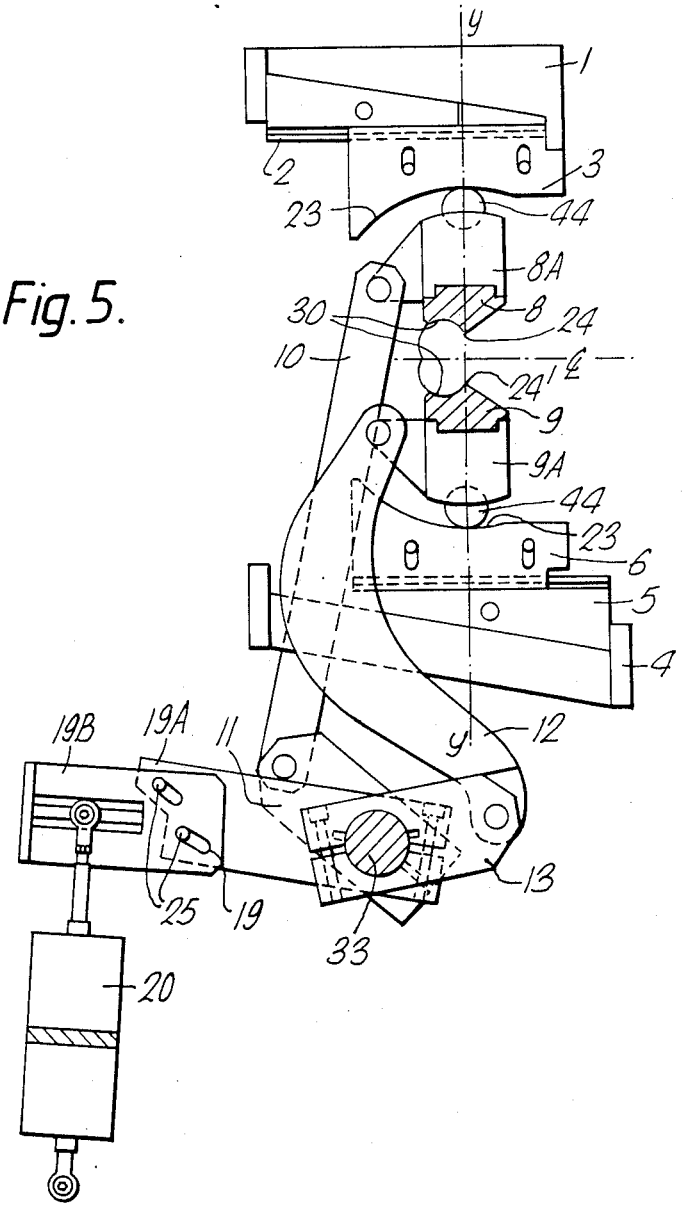

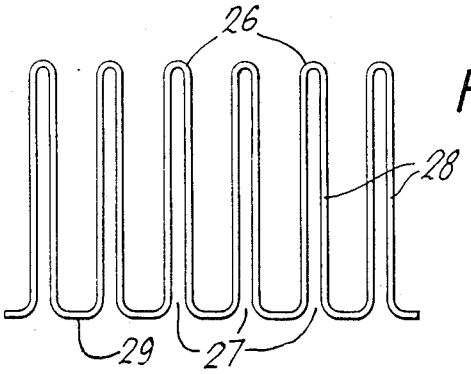
Fig. 1.
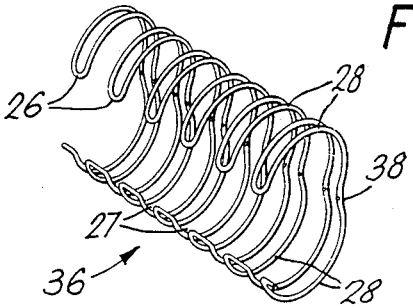
Fig. 2.
Fig. 3.
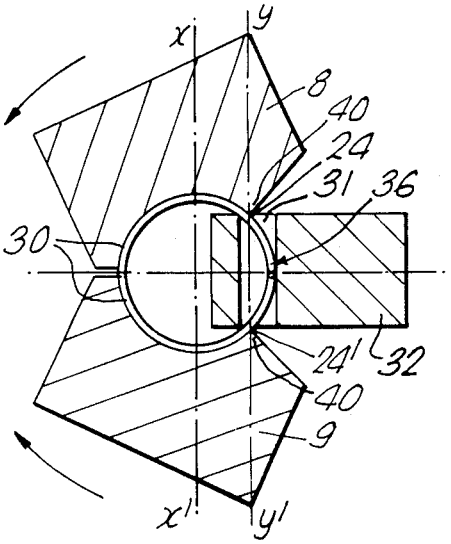
Fig. 4.
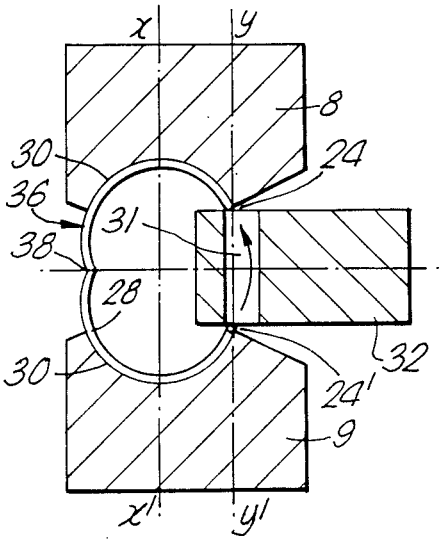

BINDING OF PERFORATED SHEETS

The invention relates to apparatus for binding bundles of perforated sheets to book form, e.g. note books, calendars, instruction manuals or the like, with wire binding elements. Apparatus which performs such binding is disclosed in our GB Pat. Nos. 1209939, 1209940 and 1541225.

The wire binding elements for use with such binding apparatus are formed from a length of metal wire which is bent to form a series of curved, hair-pin shaped prongs. The curvature of the prongs is such that the element has the appearance of an open-sided cylinder with a substantially C-shaped cross-section. Such binding elements will hereinafter be referred as to binding elements of the type described.

To bind the bundles of sheets, the elements are closed to ring shape by bringing their closed ends or 'points' into the vicinity of their open ends or 'roots', during which procedure the prongs are forced through the perforations of appropriately positioned bundles of sheets. The closing of the binding elements through the sheets is performed by two opposed closing jaws provided in the binding apparatus, between which binding elements of the type described and bundles of perforated-sheets are fed.

The closing jaws of the binding apparatus have a working surface which is a segment of a cylinder, the diameter of which corresponds to the diameter of the binding elements when closed, and are arranged to rotate in opposite directions about a fixed horizontal axis or pivot centre. As the jaws pivot, a force is applied by the working surfaces to the binding element which forces the prongs through the perforations and closes it as previously described.

The binding apparatus is also provided with means to feed bindings elements and perforated sheets to the feeding jaws between each binding stroke. Binding element feed mechanisms are disclosed in our GB Pat. Nos. 1209940 and 1541225.

Ideally the closing jaws should be set so that the edge of the working surface, which, in use, is adjacent the bundle of sheets to be bound, exactly coincides with the pivot centre of each jaw. Should the jaw not be so positioned then the edge of the working surface of the jaw will sweep in an arc when closing and the working surface will not be properly aligned to produce the correct curvature of the binding elements when closed.

Such a situation arises where larger or smaller binding elements than normal, are used and hence larger or smaller jaws are needed. Since the position of the pivot centres is related to the position of the point of attachment of the jaws, when different size jaws are fitted, the pivot centres no longer coincide with the edge of the working surface of the jaw which is adjacent the sheets to be bound.

Hitherto therefore, individual sets of binding apparatus have been required for each different size of jaw and binding elements.

Apparatus for binding perforated sheets with wire binding elements of the type described in accordance with the invention comprises a pair of opposed closing jaws, between which binding elements and bundles of perforated sheets are fed, the closing jaws each having a working surface which is a segment of a cylinder and being adapted to rotate in opposite directions about pivot centres, the pivot centre for each jaw being aligned with the edge of the working surface adjacent the bundle of sheets to be bound, wherein means are provided to adjust the position of the pivot centres towards and away for each other to accommodate closing jaws of different sizes.

Preferably the pivot centres are movable in a single vertical plane through the binding apparatus.

The path of rotation of the closing jaws may be dictated by the curvature of a cam surface formed in a cam block. Preferably the jaws are removably attached to carrier blocks which have a follower attached thereto which engages the cam surface. The position of the pivot centres may be adjusted by moving the cam blocks towards and away from one another. The cam blocks may be slidably mounted on support blocks with wedge members inserted therebetween, the position of the wedge members dictating the vertical position of the cam blocks.

Preferably the movement of the wedge members is facilitated by rotation of actuating levers connected thereto by link members. Rotation of the actuating levers in a clockwise direction is preferably arranged to move the cam blocks and hence the pivot centres towards one another and rotation of the actuating levers in an anticlockwise direction moves the cam blocks and pivot centres away from one another. The actuating levers may be operated manually, or automatically.

The closing jaws may be connected by levers to a main horizontal shaft, which shaft has connected thereto a pneumatic jack, a fixed stroke of the jack causing the shaft to rotate and the closing jaws to pivot about the pivot centres. Preferably the connecting means between the jack and the shaft is a split lever comprising two portions which are pivotable with respect to the other and secured to the main shaft, the pivotable portion being lockable in a predetermined angular relationship with the fixed portion. The two portions of the lever may be locked together by bolts.

Following movement of the cam blocks away or towards each other the vertical alignment of the closing jaws and carriers may be re-established by pivoting the pivotable portion of the split lever to rotate the main shaft and thereafter locking it to the fixed portion.

Binding apparatus in accordance with the invention may be fitted with a single pair of jaw carrier blocks which are shaped to receive many different sets of of closing jaws to suit particular binding elements. For each set of jaws fitted, the pivot centre can be adjusted, by raising and lowering the cam blocks, so that it coincides with the edge of the working surface adjacent the bundles of sheets to be bound.

Figure 6:
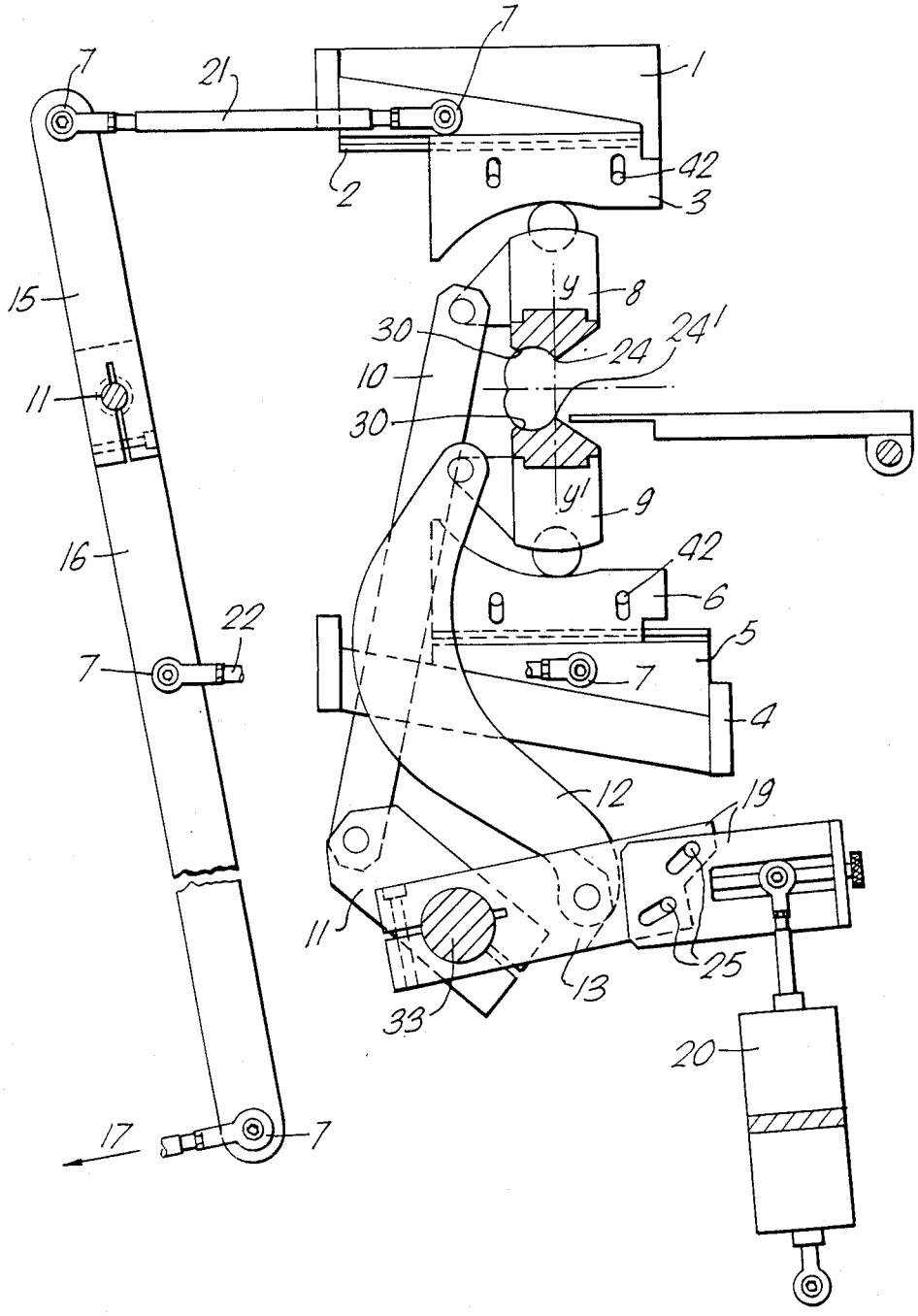
Figure 8:
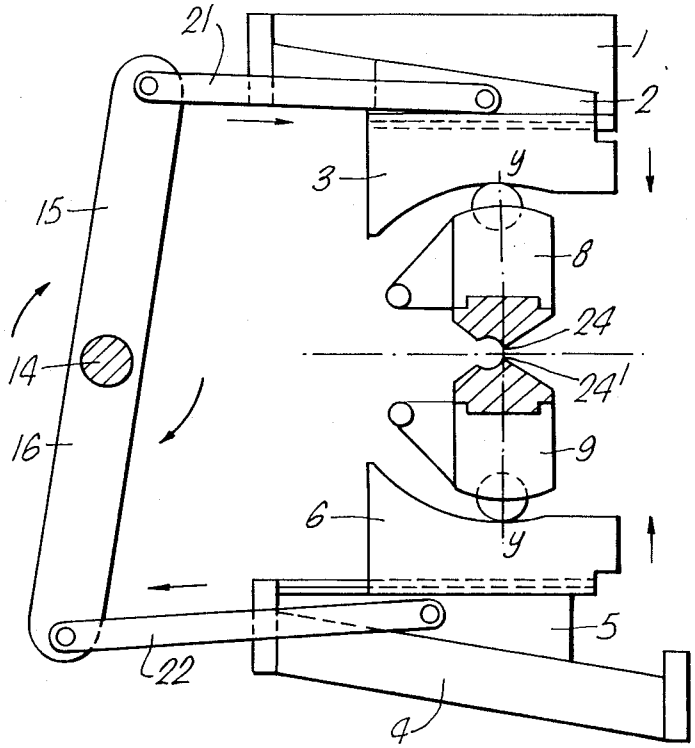
Figure 7:
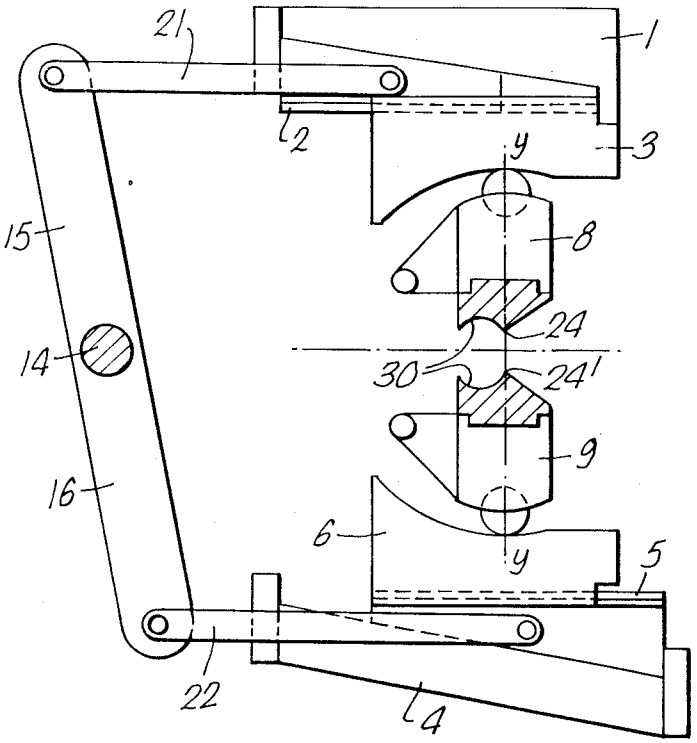
Figure 11:
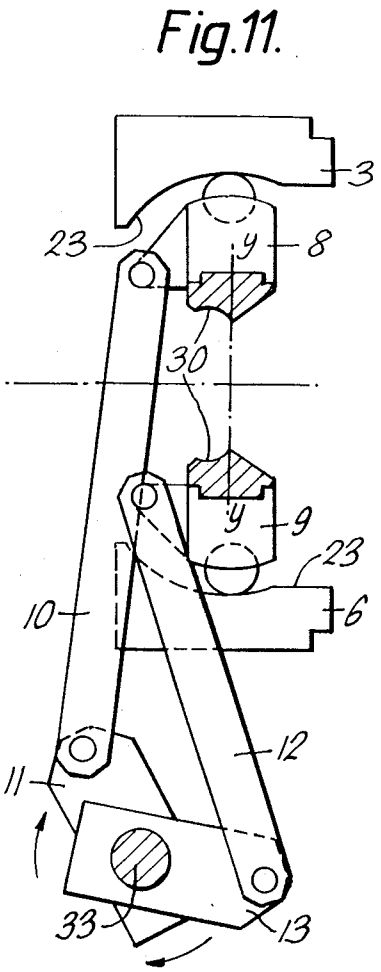
Figure 10:
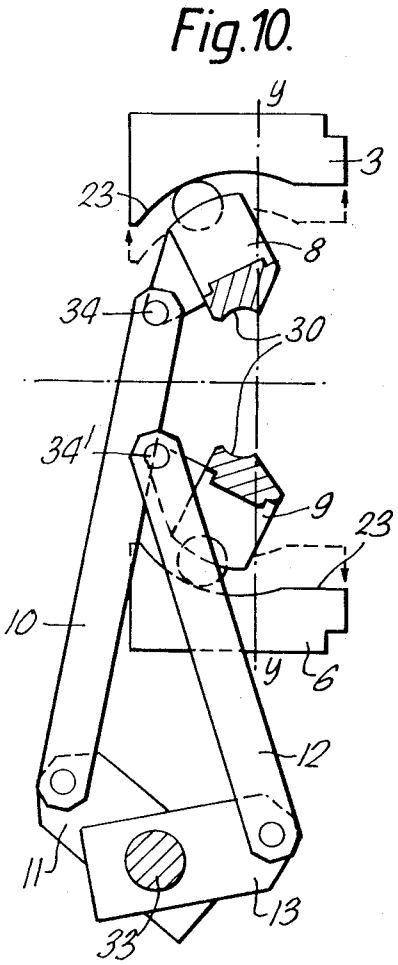
Figure 9:
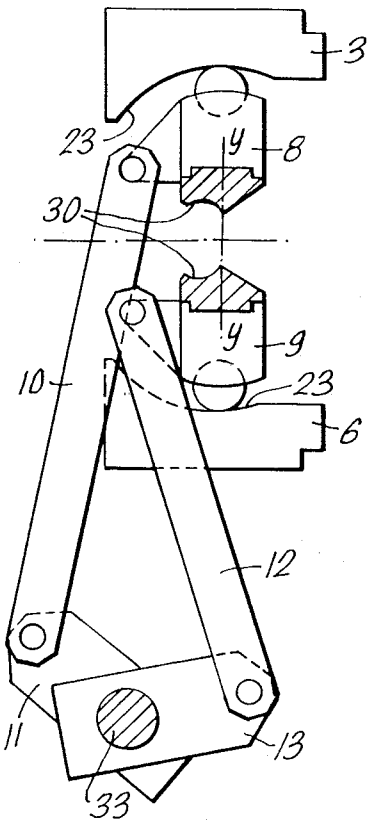
Figure 13:
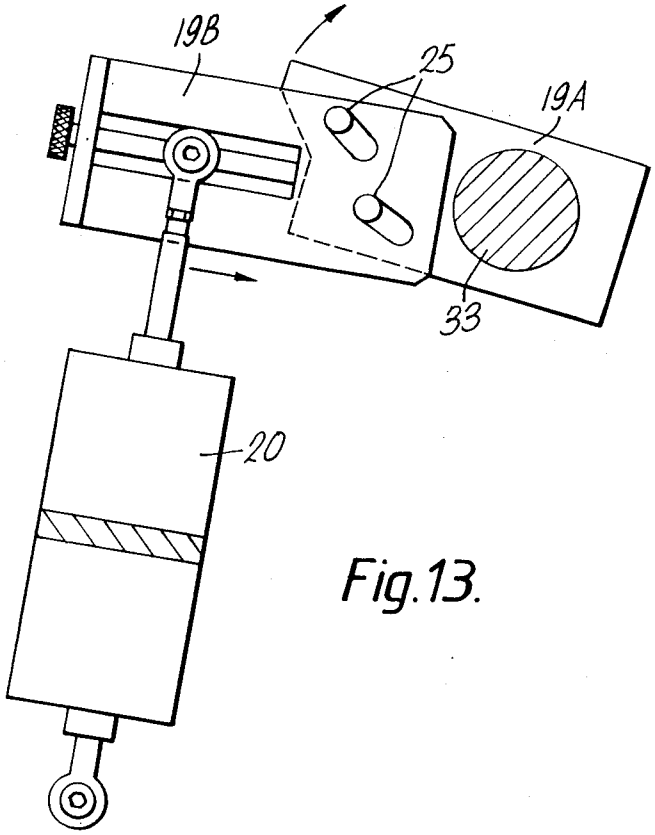
Figure 12:
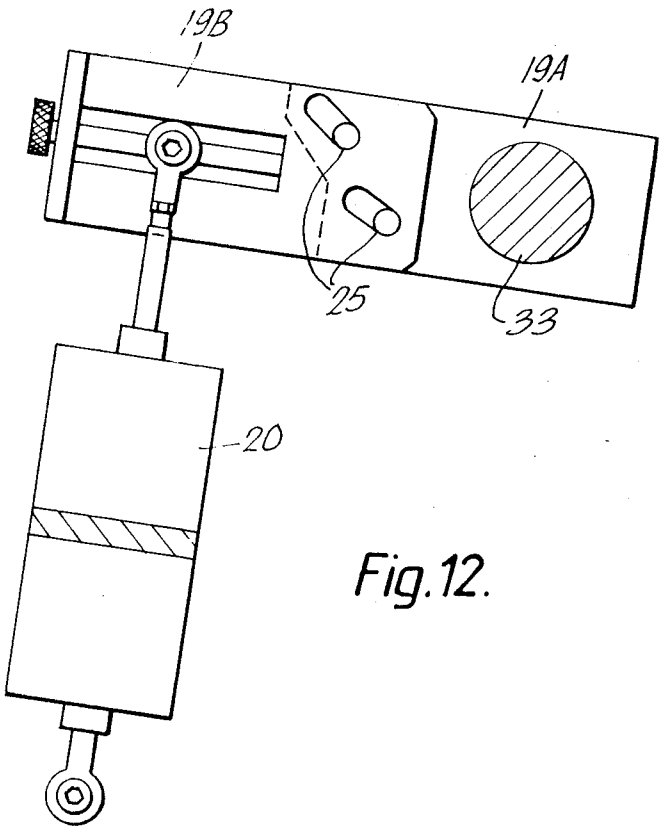

The invention will now be described by way of example with reference to the accompanying drawings in which:

FIG. 1 shows a length of metal wire from which are made binding elements for use with book binding apparatus as disclosed in GB Pat. No. 1209939, FIG. 2 shows the wire of FIG. 1 shaped into a binding element of the type described for use with the apparatus described in GB Pat. No. 1209939, FIG. 3 shows the binding element of FIG. 2 when between the closing jaws of the apparatus, with the closing jaws in the closed or 'bind' position, FIG. 4 shows the binding element of FIG. 2 when between the closing jaws of the apparatus with the jaws in the open or 'grip' position, FIG. 5 is a schematic view of book binding apparatus in accordance with the invention, FIG. 6 is an endorsed view of the apparatus of FIG. 5 showing the pivot centre adjustment mechanism, FIG. 7 is an enlarged schematic view of part of the apparatus of FIG. 5 showing the closing jaws adjusted for a large binding element, FIG. 8 is a schematic view as in FIG. 7 showing the closing jaws adjusted for a small binding element, FIG. 9 is a schematic view of part of the apparatus showing connecting levers and the main shaft with the closing jaws in the 'grip' position, and alternatively shaped levers, FIG. 10 is a view as in FIG. 9 showing position of closing jaws when the cam blocks are moved away from the centre line, FIG. 11 is a view as in FIG. 10 showing the closing jaws re-aligned in the vertical position, FIG. 12 is an enlarged schematic view of part of FIG. 5 showing the pneumatic jack, the main shaft and the split lever with locking bolts tightened, and FIG. 13 is a schematic view as in FIG. 12 with the locking bolts released.

Referring to FIGS. 1 and 2, the metal wire to be used as a book binding element is bent to form a series of curved hairpin shaped prongs 28 having straight sections 29 therebetween. Each prong 28 has a point 26 and a root 27. For insertion into the book the wire binding element 36 is curved to have a substantially C-shaped cross-section and forms an open-sided cylinder. The cylinder has a depression 38 in its wall extending over the whole of its length.

Referring now to FIGS. 3 and 4 the binding element 36 is shown fitted between the closing jaws 8 and 9 of the binding apparatus. The jaws 8 and 9 have working surfaces 30 which are segments of cylinders whose centres are on the line X—X. The jaws 8 and 9 are arranged to pivot about pivot centres 24 and 24' which are in the plane Y—Y. The pivot centres 24 and 24' are equidistant from the horizontal centre line $C_L$ and are spaced apart a distance slightly greater than the maximum thickness of a book 32 whose leaves are to be bound in the apparatus. The edges 40 of the working surfaces 30 coincide with the pivot centres 24 and 24'. This positioning means that, on pivotting the jaws 8 and 9 from the 'grip' position shown in FIG. 4 to the 'bind' position shown in FIG. 3, the pivot centres 24 and 24' always remain in the plane Y—Y. When the jaws 8 and 9 are rotated anti-clockwise through the pivot centres 24 and 24' a force is transmitted by the working surfaces 30 of the closing jaws which causes the binding element points 26 to be forced through the perforations in the book so that they mesh with the roots 27 to form a tight bind.

The position of the closing jaws within the binding apparatus is shown in FIG. 5. The jaws 8 and 9 are mounted on tool carrier blocks 8A and 9A. Each tool carrier block 8A and 9A is pivotally connected to levers 10 and 12 respectively. The levers 10 and 12 extend downwardly from the tool carrier blocks, their lower ends being attached to connecting levers 11 and 13 which themselves are secured to the main shaft 33.

The shaft 33 is connected to pneumatic jacks 20 via a split lever 19 consisting of two components 19A and 19B. The two components are held fixedly together by locking bolts 25 so that a fixed stroke of the pneumatic jacks 20 causes the shaft 33 to rotate through a fixed distance. If the shaft 33 is rotated in an anti-clockwise direction the connecting levers 11 and 13 and the levers 10 and 12 act to pivot the tool carrier blocks and closing jaws 8 and 9, into the 'bind' position, about the pivot centre 24 and 24'. The pneumatic jacks 20 are therefore arranged to be actuated once a binding element 36 and the book 32 to be bound have been correctly positioned between the closing jaws.

The top or bottom respectively of the tool carrier blocks 8A and 9A are held in support brackets on which a follower 44 is attached and which engages and runs along a cam surface 23 formed in cam blocks 3 and 6. The curvature of the cam surface 23 dictates the path of rotation of the closing jaws 8 and 9 about pivot centres 24 and 24'. Therefore the position of the cam blocks 3 and 6 dictates the position of the pivot centres 24 and 24' on either side of the centre line $C_L$. When the closing jaws 8 and 9 are positioned nearer to, or further from, the centre line $C_L$, than the pivot centres, the edge of the working surface 40 sweeps in an arc during binding and the working surfaces 30 are incorrectly positioned for closing the binding elements 36. It is therefore necessary to adjust the position of the pivot centres 24 and 24' when new jaws are attached to carrier blocks 8A and 9A.

Movement of the pivot centres in the plane Y—Y towards and away from the centre line $C_L$ is achieved by raising and lowering the cam blocks 3 and 6 relative to the centre line. The complete mechanism is shown in FIG. 6.

The cam blocks 3 and 6 are mounted on support blocks 1 and 4 respectively, in a slidable manner, by means of slotted links 42. The support blocks 1 and 4 have a space into which wedges 2 and 5 are inserted, the wedges being movable with respect to both the supporting blocks 1 and 4 and their cam blocks 3 and 6. The upper wedge 2 is connected to a top actuating lever 15 via linkage 21 and the wedge 5 is connected to a bottom actuating lever 16 via linkage 22. The linkages 21 and 22 are ball-jointed rods or a similar rigid linkage which can be adjusted when initially setting the apparatus. The movement of the wedges 2 and 5 and hence the cam blocks 3 and 6 is shown in FIGS. 7 and 8.

Referring first to FIG. 8 the actuating levers 15 and 16 are rotated about a fulcrum point given by the centre of the shaft 14. When the top actuating lever 15 is rotated in a clockwise direction, the movement 15 transmitted to the wedge 2 via linkage 21. As the wedge travels along the support block 1 it moves cam block 3 towards the centre line $C_L$. The cam block 3 forces the closing jaw 8 and carrier 8A downwards and the pivot centre 24 is moved nearer to the centre line. At the same time an equal rotation of the bottom actuating lever 16 in a clockwise direction about the shaft 14 occurs. This movement is transmitted to wedge 5 via linkage 22 and the wedge moves along support block 4, pushing as it does so, the cam block 6 upwards towards the centre line. Thus the jaw 9, carrier 9A and pivot centre 24' are moved towards the centre line a distance equal to that of jaw 8 and pivot centre 24.

As shown in FIG. 7 rotating actuating levers 15 and 16 in an anti-clockwise direction about the fulcrum given by the shaft 14, increases the distance between the pivot centres 24 and 24' by moving the cam blocks apart.

The actuating levers 15 and 16 are connected to a prime mover 17 (see FIG. 6) which when pulled in the direction of the arrow rotates the levers in a clockwise direction to move the cam blocks 3 and 6 towards the centre line. By pulling the prime mover 17 in the opposite direction the sequence of events is reversed.

FIG. 9 shows the position of the closing jaw carriers 8A and 9A, the main shaft 33, levers 11 and 13 and cam blocks 3 and 6 when the minimum distance between the pivot centres 24 and 24' occurs. When the cam blocks 3 and 6 are moved away from the centre line by the wedge mechanism described previously, the pivot centres 24 and 24' separate along the vertical plane Y—Y and the closing jaw carriers 8A and 9A rotate about points 34 and 34' causing them to travel up the marking surfaces 23 of the cam blocks. The jaws 8 and 9 are therefore misaligned, as shown in FIG. 10. Restoration of the carriers and closing jaws 8 and 9 to the correct vertical alignment (as shown in FIG. 11) while maintaining the pivot centres 24 and 24' in the new raised position is accomplished by rotating the main shaft 33 in a clockwise direction relative to the pneumatic jack 20. When the binding apparatus is in operation such rotation is not possible because the two components of the bind lever 19A and 19B are rigidly fixed together by fixing bolts 25 as shown in FIG. 12. However when it is desired to vertically re-align the carriers 8A and 9A after moving the cam blocks 3 and 6 away from the centre line, the bolts can be loosened so that split lever part 19A pivots with respect to 19B and hence rotates main shaft 33 a small distance in a clockwise direction as shown in FIG. 13. The bolts 25 are then tightened to maintain the part 19A in its adjusted position and the closing jaw carrier alignment is corrected. Further the binding lever part 19B is nearer the centre of the main shaft 33 thus reducing the radius at which the pneumatic jacks are acting and ensuring sufficient rotation of the shaft when binding.

There are a number of alternative mechanisms envisaged by which the pivot centres may be adjusted. For example, the prime mover 17 may be manually operated by hand or treadle or automatically operated by pneumatic or hydraulic jack or electric motor and gear system. The movement can be between two dead stops only, or incremental within a range of preset stops, or infinitely variable with a setting for upper and lower limits only. Further wedges of different angles may be combined for insertion between the cam blocks and supports.

Wedges are not the only method available for raising and lowering the cam blocks. Alternatives include mounting the cam blocks on a single shaft having right and left handed threads so that rotation of the shaft moves the cam blocks towards and away from the centre line or fitting cams on two parallel shafts which are geared together so that rotation of a handwheel causes the cams to act on the cam block in the manner of overhead cams in motor cars. Further alternatives which may be used are direct acting levers or toggle linkages.

What I claim is:

1. A machine for binding perforated sheets with a wire binding element of the kind having a series of curved prongs which define plural points and plural roots, said sheets being bound upon closing said prongs through said sheets' perforations by bringing said points into the vicinity of said roots, said machine comprising two opposed closing jaws, said jaws being spaced one from the other at an element gripping position, each of said jaws defining an arcuate working surface adapted to cooperate with said element for closing said element's prongs, one edge of each jaw's working surface defining a pivot axis on which that jaws pivots between said element gripping position at which a binding element is oriented in preliminary position with said sheet's perforations before being closed into binding relation with said sheets and an element binding position at which said binding element is closed into binding relation with said sheets, a jaw operating mechanism connected with said jaws for opening and closing said jaws between said element gripping position and said element binding position, and a jaw opening size adjustment mechanism connected with said jaws, for moving said jaws' pivot axes toward and away from one another as desired in order to vary the distance between said jaws' pivot axes, said size adjustment mechanism permitting the spacing between said closing jaws to be varied as required in order to accommodate wire binding elements of different sizes.

2. A machine as claimed in claim 1, said pivot axes being movable in a single generally vertical plane.

3. A machine as claimed in claim 1, said jaw operating mechanism comprising a cam surface defined on a cam block, the motion path of said jaws during a binding operation being dictated by the curvature of said cam surface.

4. A machine as claimed in claim 3, said jaw operating mechanism comprising a carrier block to which each jaw is removably attached, and a follower connected to each carrier block, said follower being adapted to engage said cam surface.

5. A machine as claimed in claim 4, the position of said pivot axes being adjusted by moving said cam blocks toward or away from one another.

6. A machine as claimed in claim 5, said size adjustment mechanism comprising a wedge member movable horizontally between two parts of a support block, said cam block being vertically movable on said support block, the vertical position of said cam block relative to said support block being determined by said wedge member.

7. A machine as claimed in claim 6, said size adjustment mechanism comprising actuating levers connected to said wedge members by links, movement of said wedge members being caused by pivoting said actuating levers.

8. A machine as claimed in claim 1, said operating mechanism comprising operating levers connected to said jaws and to a main horizontal shaft driven by a pneumatic jack, a stroke of said jack causing said shaft to rotate and said jaws to pivot about their pivot axes.

9. A machine as claimed in claim 8, said operating mechanism comprising a split lever connecting said jack and said main shaft, one portion of said split lever being pivotable relative to the other portion of said split lever, said one portion being adjustably lockable in a predetermined angular relationship relative to said other portion.

* * * * *